US009808053B2

(12) United States Patent
Jakubowski

(10) Patent No.: US 9,808,053 B2
(45) Date of Patent: Nov. 7, 2017

(54) MAGNETIC CLASP FOR JEWELRY

(71) Applicant: VILMAS GmbH, Pforzheim (DE)

(72) Inventor: Antonio Jakubowski, Pforzheim (DE)

(73) Assignee: Vilmas GmbH, Pforzheim (DE)

( * ) Notice: Subject to any disclaimer, the term of this patent is extended or adjusted under 35 U.S.C. 154(b) by 0 days.

(21) Appl. No.: 15/346,635

(22) Filed: Nov. 8, 2016

(65) Prior Publication Data

US 2017/0049194 A1 Feb. 23, 2017

Related U.S. Application Data

(63) Continuation of application No. PCT/EP2015/059798, filed on May 5, 2015.

(30) Foreign Application Priority Data

May 13, 2014 (DE) ..... 10 2014 106 699

(51) Int. Cl.
*A44C 5/20* (2006.01)

(52) U.S. Cl.
CPC ..... *A44C 5/2085* (2013.01); *A44C 5/2071* (2013.01); *A44D 2203/00* (2013.01); *Y10T 24/32* (2015.01)

(58) Field of Classification Search
CPC ..... Y10T 24/32; A44C 5/2076; A44C 5/2085; A44C 5/2071; A44D 2203/00
USPC ..... 63/900
See application file for complete search history.

(56) References Cited

U.S. PATENT DOCUMENTS

2012/0044031 A1* 2/2012 Ninomiya ..... H01F 7/0263 335/219
2015/0074954 A1* 3/2015 Pruitt ..... A44C 5/2071 24/303

FOREIGN PATENT DOCUMENTS

| | | | |
|---|---|---|---|
| DE | 201 08 588 | U1 | 9/2001 |
| DE | 202 05 173 | U1 | 8/2002 |
| DE | 10 2008 020 764 | A1 | 10/2009 |
| EP | 0 462 072 | A1 | 12/1991 |

* cited by examiner

*Primary Examiner* — Abigail Troy
(74) *Attorney, Agent, or Firm* — Hackler Daghighian Martino & Novak

(57) ABSTRACT

A magnetic clasp for jewelry has a first and a second coupling part each having a magnet and an abutment surface which are pulled against one another by a magnetic force of attraction when closed. The two coupling parts each have a fastening element for fastening jewelry and predefine a pulling direction when closed. The first coupling part defines a receptacle for the second coupling part to engage when the clasp is closed. The second coupling part has an undercut which forms an interlock acting against the pulling direction. The abutment surfaces are at an incline to the pulling direction and the first coupling part forms a sliding surface which, when the clasp is closed and pressure acts on the second coupling part oppositely to the pulling direction, allows a displacement of the second coupling part relative to the first coupling part, thus opening the clasp.

11 Claims, 2 Drawing Sheets

MAGNETIC CLASP FOR JEWELRY

CROSS-REFERENCE TO RELATED APPLICATIONS

This continuation application claims priority to PCT/EP2015/059798 filed on May 5, 2015 which has published as WO 2015/173064 A1 and also the German application number 10 2014 106 699.5 filed on May 13, 2014, the entire contents of which are fully incorporated herein with these references.

DESCRIPTION

Field of the Invention

The present invention relates to a magnetic clasp for jewelry. More particularly, it relates to a clasp having the features of the preamble of the independent claims, which is also known from DE 201 08 588 U1.

Background of the Invention

Magnetic clasps for jewelry consist of two coupling parts which each have a magnet and an abutment surface. When the clasp is closed, the abutment surfaces of the two coupling parts are pulled against one another by magnetic force. Interlocking secures the clasp so as to prevent the two coupling parts from being pulled apart from one another accidentally.

In some clasps the abutment surfaces are formed entirely by the magnets. In other clasps the abutment surfaces are much larger and additionally also comprise a surface bearing against or surrounding the magnets. For example, a magnet may be placed in a flush manner in a blind bore arranged in a flat surface. Each of the two clasp parts usually has a permanent magnet. However, it is also possible to replace one of the two permanent magnets by a soft magnet, for example a piece of iron.

Each of the two coupling elements of a clasp has a fastening element for fastening to an item of jewelry, generally a necklace or a bracelet. Conventional fastening elements are an eyelet or a pin, for example. The fastening elements define a pulling direction, since, when the clasp is closed, tension is exerted onto the fastening elements via the item of jewelry by pulling and the clasp must withstand said pulling. Document DE 201 08 588 U1 discloses a magnetic clasp in which the abutment surfaces of the two coupling elements are arranged parallel to the pulling direction. The first coupling part of the clasp has a receptacle into which the second coupling part is inserted. The first coupling part fills out the receptacle of the second coupling part in a flush manner, such that the clasp has a smooth upper side and underside and can be formed very flat.

Document DE 201 08 588 U1 discloses a further clasp in which the two abutment surfaces are arranged perpendicularly to the pulling direction. In this clasp the two coupling parts must be displaced relative to one another parallel to the abutment surface so that undercuts in the coupling parts enter into engagement and therefore an interlock against the pulling direction can be formed. Clasps having abutment surfaces that are arranged perpendicularly to the pulling direction are also known from DE 202 05 173 U1, DE 10 2008 020 764 A1 and EP 0 462 072 A1.

It is desired to open and close magnetic clasps as easily as possible by hand. An accidental opening of a clasp should be reliably prevented. An object of the present invention is to create a clasp which satisfies these demands in an even better way.

The object is achieved by a clasp having the features specified in the independent claims. Advantageous refinements of the invention are disclosed by dependent claims.

SUMMARY OF THE INVENTION

A clasp according to the invention for jewelry has, similarly to conventional clasps, a first and a second coupling part each comprising a magnet and an abutment surface, wherein the abutment surfaces of the two coupling parts are pulled against one another by a magnetic force of attraction when the clasp is closed. The first coupling part has walls which rise upwardly on opposite sides of the abutment surface of the first coupling part and define a receptacle in which the second coupling part engages when the clasp is closed. The second coupling part has an undercut which, together with the receptacle in the first coupling part, forms an interlock acting against the pulling direction.

In the case of a clasp according to the invention, the abutment surfaces are arranged at an incline to the pulling direction so that, when the clasp is closed, the two coupling parts are displaced relative to one another by pressure acting oppositely to the pulling direction, and the clasp is opened. The first coupling part thus forms a sliding guide which, when the clasp is closed, enables a displacement of the second coupling part relative to the first coupling part. A very high level of reliability of the clasp can thus be combined with a simple operation. Pushing against the pulling direction can also be easily exerted using just one hand, thus opening the clasp. Pushing force is not exerted coincidentally in the case of a bracelet or a necklace, and therefore an undesirable opening of the clasp is practically eliminated.

If, when the clasp is closed, pressure is exerted onto the second coupling part in the direction opposite the pulling direction, the pushing force is divided into a component parallel to the abutment surface and a component perpendicular to the abutment surface on account of the inclined position of the abutment surface. The component parallel to the abutment surface causes the displacement, whereas the component perpendicular to the abutment surface as well as the magnetic force cause an increase in the frictional force. The angle between the abutment surface and the pulling direction can be varied within wide limits. A normal vector of the flat abutment surface (i.e. a vector perpendicular to the sur-face) may enclose an angle between 30° and 60° with the pulling direction.

An advantageous refinement of the invention is configured so that, in the case of a closed clasp the second coupling part comprises two support surfaces contacting the walls of the first coupling part. The fastening element of the second coupling part is arranged between these two support surfaces as viewed in the pulling direction. The two coupling parts can thus be joined in an elegant manner to form a clasp, which for example can have the form of a pearl.

In further advantageous refinement of the invention, the first coupling part has an opening, opposite the fastening element of said coupling part and between the walls rising on opposite sides of the abutment surface, which opening, when the clasp is closed, is filled by the second coupling part and widens upwardly. When the magnetic force during the closing process draws the second coupling part into the receptacle in the first coupling part, an upwardly widening opening facilitates a correct positioning of the two coupling parts relative to one another. The opening can widen for example in steps in that the walls rising on opposite sides of the abutment surface each form a step in the opening. When the clasp is closed, the two support surfaces of the second coupling part rest on the two steps formed by the rising walls on opposite sides of the abutment surface.

BRIEF DESCRIPTION OF THE DRAWINGS

Further details and advantages of the invention will be explained on the basis of an illustrative embodiment of the invention with reference to the accompanying drawings, in which.

DETAILED DESCRIPTION OF THE PREFERRED EMBODIMENTS

Figure 1:
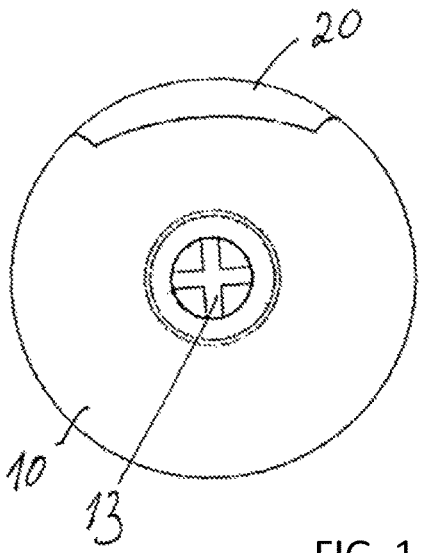
FIG. 1 shows a magnetic clasp in the closed state.
Figure 2:
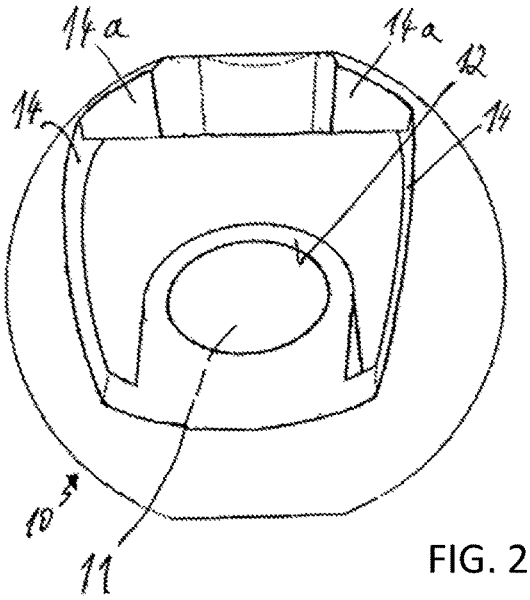
FIG. 2 shows the first coupling part of the clasp.
Figure 3:
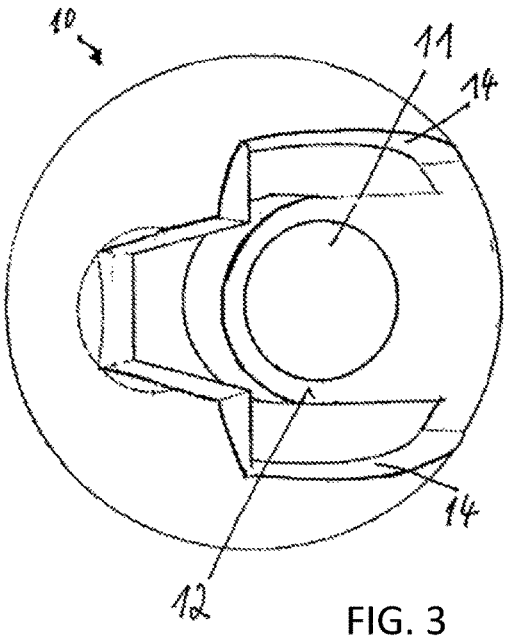
FIG. 3 shows a further view of the first coupling part.
Figure 4:
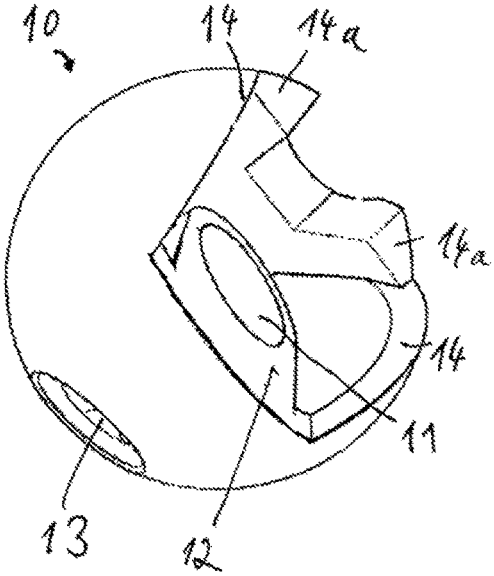
FIG. 4 shows a further view of the first coupling part.
Figure 5:
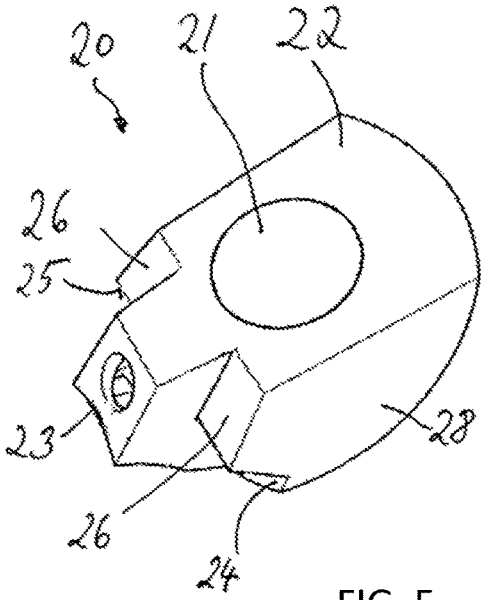
FIG. 5 shows the second coupling part of the clasp.
Figure 6:
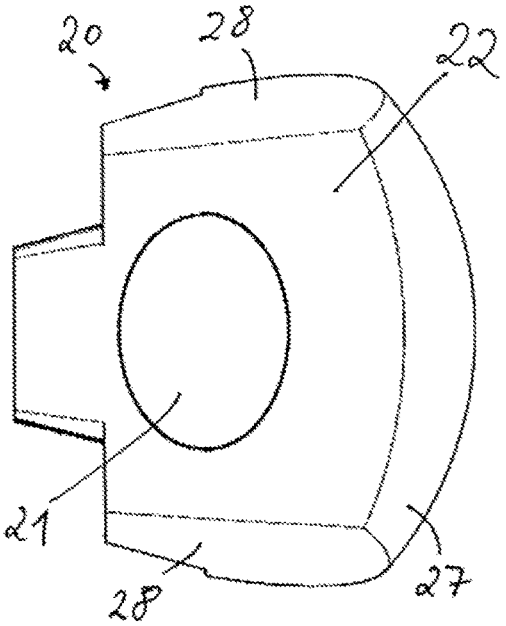
FIG. 6 shows a further view of the second coupling part.
Figure 7:
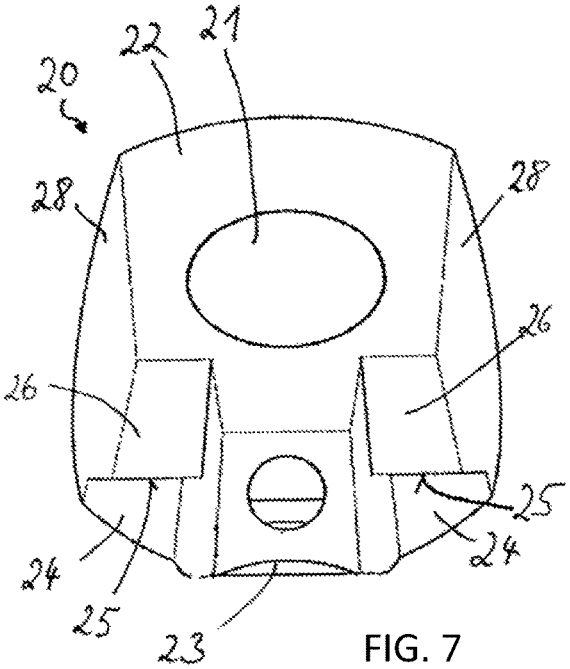
FIG. 7 shows a further view of the first coupling part.
Figure 8:
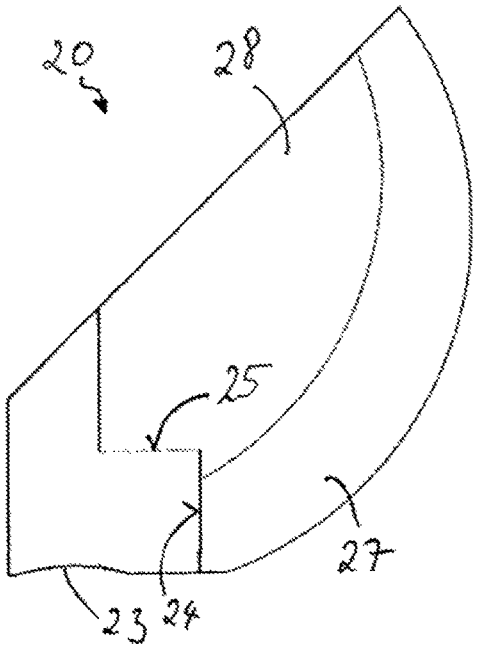
FIG. 8 shows a further view of the first coupling part.

The magnetic clasp illustrated in FIG. 1 consists of a first coupling part 10 and a second coupling part 20. The first coupling part 10 is shown in different views in FIGS. 2 to 4. The second coupling part 20 is shown in different views in FIGS. 5 to 8.

The coupling parts 10, 20 each comprise a magnet 11, 21 and an abutment surface 12, 22. When the clasp is closed, the abutment surfaces 12, 22 of the two coupling parts 10, 20 bear against one another and are pulled against one another by a magnetic force of attraction. The abutment surfaces can be formed as an upper side of the magnets or as a flat surface which borders the magnets. In the embodiment shown the magnets 11, 21 are arranged in a flush manner in blind bores and each form an abutment surface 12, 22 with a surface surrounding the blind bore.

The first coupling part 10 has a fastening element 13 and the second coupling part 20 has a fastening element 23 for fastening to an item of jewelry, for example a necklace. The fastening elements 13, 23, when the clasp is closed, define a pulling direction in which the clasp is loaded. The fastening elements 13, 23 can be formed for example as an eyelet or pin.

The first coupling part 10 has walls 14, which rise upwardly on opposite sides of the abutment surface 12 of the first coupling part 10 and define a receptacle, in which the second coupling part 20 engages in an interlocking manner when the clasp is closed. Between these walls 14, the first coupling part 10 has an opening opposite the fastening element 13 of said coupling part, which opening, when the clasp is closed, is filled by the second coupling part 20 and widens upwardly in a stepped manner. The walls 14 rising on opposite sides of the abutment surface 12 each specifically form a step 14*a*. When the clasp is closed, the second coupling part 20 rests, via two support surfaces 24 between which the fastening element 23 of the second coupling part 20 is arranged as viewed in the pulling direction, on the portions of the walls 14 of the first coupling part 10 forming this step 14*a*.

The abutment surfaces 12, 22 of the two coupling parts 10, 20 are arranged at an incline to the pulling direction. A vector perpendicular to the flat abutment surfaces 10, 20 may encloses an angle between 30° and 60° with the pulling direction. The first coupling part 10 forms a sliding guide via its walls 14, which sliding guide, when the clasp is closed and the second coupling part 20 is pushed in a direction opposite to the pulling direction, enables a displacement of the second coupling part 20 relative to the first coupling part 10. Pushing on the second coupling part 20 against the pulling direction thus causes the abutment surfaces 12, 22 of the two coupling parts 10, 20 to slide along one another and thus opens the clasp.

When the clasp is closed, the second coupling part 20 is secured in the receptacle of the first coupling part 10 by an interlock acting in the pulling direction. The second coupling part 20 for this purpose has an undercut which together with the receptacle in the first coupling part 10 forms an interlock acting against the pulling direction. The undercut in the second coupling part 20 is formed by two stop surfaces 25, between which, as considered in the pulling direction, the fastening element 23 of the second coupling part 20 is arranged. The two stop surfaces 25 are arranged at an acute angle to the abutment surface 22 of the second coupling part 20, e.g. at an angle between 80° and 40°, for example 70° to 50°. When the clasp is subjected to tensile load caused by pulling, the stop surfaces 25 are pressed against the portions of the walls 14 of the first coupling part 10 bordering the opening.

The two stop surfaces 25 may end at a distance from the abutment surface 22. By way of example, the stop surfaces 25 can each be connected to the abutment surface 22 via a surface 26 which runs at an incline to the abutment surface 22 or is rounded.

The stop surfaces 25 can border support surfaces 24 which, when the clasp is closed, rest on portions of the walls 14 of the first coupling part 10, for example on the wall portions 14*a* forming a step or shoulder. In the embodiment shown, the fastening part 23 of the second coupling part 20 is arranged between the two support surfaces 24 as considered in the pulling direction. The support surfaces 24 are arranged transversely to the stop surfaces 25, for example at an angle between 80° and 100°. The support surfaces 24 can be arranged perpendicularly to the stop surfaces 25.

The abutment surface 22 of the second coupling part borders sloping side surfaces 28 on opposite side edges. The side surfaces 28 can be arranged at an incline to the abutment surface 22. For example the side surfaces 28 may each enclose an angle between 95° and 130° with the abutment surface 22. The width of the second coupling part 20, as measured from one side surface 28 to the opposite side surface 28, then increases with increasing distance from the abutment surface 22. This form of the second coupling part 20 makes it easier to insert said coupling part into the receptacle in the first coupling part 10. The abutment surface 22 of the second coupling part 20, at its end facing away from the fastening element 23 of the second coupling part 20, borders an outer surface 27 of the clasp and of the second coupling part 20.

The abutment surface 22 of the second coupling part 20 can widen towards its end facing away from the fastening element 23 of the second coupling part 20. This is advantageous when the two coupling parts 10, 20 supplement one another to form a sphere, as in the illustrated embodiment. The walls 14 of the first coupling part 10 have an arcuately rounded edge when the closed clasp has the form of a pearl.

LIST OF REFERENCE SIGNS

10 first coupling part
11 magnet
12 abutment surface
13 fastening element
14 wall

14*a* step-forming wall portion
20 second coupling part
21 magnet
22 abutment surface
23 fastening element
24 support surface
25 stop surface
26 surface
27 outer surface
28 side surface

What is claimed is:

1. A magnetic clasp for jewelry, said magnetic clasp comprising:

a first and a second coupling part each having a magnet and an abutment surface;

wherein the abutment surfaces of the first and second coupling parts are pulled against one another by a magnetic force of attraction when the clasp is closed;

wherein the first and second coupling parts each have a fastening element for fastening to the jewelry and, when the clasp is closed, the fastening elements define a pulling direction of the clasp;

wherein the first coupling part has walls which rise upwardly on opposite sides of the abutment surface of the first coupling part and define a receptacle in which the second coupling part engages when the clasp is closed;

wherein the second coupling part has an undercut which, together with the receptacle of the first coupling part, forms an interlock acting against the pulling direction;

wherein the abutment surfaces are arranged at an incline to the pulling direction and the first coupling part forms a sliding surface which, when the clasp is closed and pressure acts on the second coupling part in a direction opposite to the pulling direction, allows a displacement of the second coupling part relative to the first coupling part, thus opening the clasp; and wherein the first coupling part has an opening arranged opposite the fastening element of said first coupling part and between the walls rising on the opposite sides of the abutment surface, wherein the opening, when the clasp is closed, is filled by the second coupling part and widens upwardly.

2. The magnetic clasp according to claim 1, wherein each of the walls rising on the opposite sides of the abutment surface of the first coupling part includes a step, wherein the steps partially define a boundary of the opening.

3. The magnetic clasp according to claim 1, wherein the second coupling part, when the clasp is closed, rests, via two support surfaces between which the fastening element of the second coupling part is arranged as seen in the pulling direction, on the walls of the first coupling part.

4. The magnetic clasp according to claim 1, wherein the undercut in the second coupling part is formed by two stop surfaces between which the fastening element of the second coupling part is arranged as aligned in the pulling direction, wherein the two stop surfaces are arranged at an acute angle to the abutment surface of the second coupling part.

5. The magnetic clasp according to claim 4, wherein the support surfaces border the stop surfaces and run transversely thereto.

6. The magnetic clasp according to claim 1, wherein the abutment surface of the second coupling part widens from its end facing away from the fastening element of the second coupling part.

7. The magnetic clasp according to claim 1, wherein the abutment surface of the second coupling part borders, on opposite side edges, side surfaces of the second coupling part, wherein each side surface is at an angle less than 270 degrees relative to the abutment surface but more than 180 degrees relative to the abutment surface.

8. The magnetic clasp according to claim 1, wherein the abutment surface of the second coupling part borders an outer surface of the clasp at its end facing away from the fastening element of the second coupling part.

9. The magnetic clasp according to claim 1, wherein the walls of the first coupling part are arcuately rounded.

10. A magnetic clasp for jewelry, said magnetic clasp comprising:

a first coupling part having a first magnet, a first abutment surface and a first fastening element;

a second coupling part having a second magnet, a second abutment surface and a second fastening element;

wherein the first and second abutment surfaces of the first and second coupling parts are pulled against one another by the first and second magnets when the clasp is closed;

wherein the first and second fastening element are each configured to fasten to the jewelry, wherein when the clasp is closed the first and second fastening elements define a pulling direction of the clasp;

wherein the first coupling part has walls which rise and widen upwardly on opposite sides of the first abutment surface and define an opening arranged opposite the first fastening element, wherein when the clasp is closed the opening is filled by the second coupling part;

wherein the second coupling part has an undercut which, together with the receptacle of the first coupling part, forms an interlock acting against the pulling direction when the clasp is closed; and wherein the first and second abutment surfaces are arranged at an incline to the pulling direction and together form a sliding surface which, when the clasp is closed and pressure acts on the second coupling part in a direction opposite to the pulling direction, allows a displacement of the second coupling part relative to the first coupling part, thus opening the clasp.

11. The magnetic clasp according to claim 10, wherein when the clasp is closed the first and second coupling parts form an outside surface comprising a sphere.

* * * * *